US009173805B2

(12) United States Patent
Troyka

(10) Patent No.: US 9,173,805 B2
(45) Date of Patent: Nov. 3, 2015

(54) SUPPORT FOR COPULATING COUPLES AND METHOD OF USE

(76) Inventor: David Alan Troyka, Snellville, GA (US)

( * ) Notice: Subject to any disclaimer, the term of this patent is extended or adjusted under 35 U.S.C. 154(b) by 395 days.

(21) Appl. No.: 13/316,552

(22) Filed: Dec. 11, 2011

(65) Prior Publication Data

US 2012/0145165 A1 Jun. 14, 2012

Related U.S. Application Data

(63) Continuation-in-part of application No. 12/967,033, filed on Dec. 13, 2010, now abandoned.

(51) Int. Cl.

| | |
|---|---|
| ***A61G 15/00*** | (2006.01) |
| ***A61H 19/00*** | (2006.01) |
| ***A47C 15/00*** | (2006.01) |
| *A47G 9/00* | (2006.01) |

(52) U.S. Cl.

CPC ..... *A61H 19/50* (2013.01); *A47C 15/008* (2013.01); *A47G 2009/002* (2013.01)

(58) Field of Classification Search

CPC . A47C 15/008; A47G 2009/002; A61H 19/50
USPC ..... 128/845; 606/38; 5/630, 632–633, 652, 5/655.9, 929, 953, 657, 902
See application file for complete search history.

(56) References Cited

U.S. PATENT DOCUMENTS

| | | | | |
|---|---|---|---|---|
| 1,266,367 | A | | 5/1918 | Wilson |
| 2,295,906 | A | | 9/1942 | Lacour |
| 2,478,497 | A | | 8/1949 | Morrison |
| 2,782,427 | A | * | 2/1957 | Ericson ..... 5/632 |
| 2,839,766 | A | * | 6/1958 | Hull ..... 5/632 |
| 3,003,815 | A | * | 10/1961 | Zinn ..... 297/118 |
| 3,189,919 | A | | 6/1965 | Chase |
| 3,273,174 | A | * | 9/1966 | Cassini ..... 5/633 |
| 3,505,994 | A | * | 4/1970 | Smith, Jr. ..... 602/24 |
| 3,855,652 | A | | 12/1974 | Nicholson |
| 3,901,228 | A | * | 8/1975 | Brown ..... 5/651 |
| 4,118,813 | A | | 10/1978 | Armstrong |
| 4,210,317 | A | | 7/1980 | Spann |
| 4,235,472 | A | * | 11/1980 | Sparks et al. ..... 297/392 |
| 4,270,235 | A | | 6/1981 | Gutmann |
| D268,784 | S | | 4/1983 | Forseth |
| 4,397,052 | A | * | 8/1983 | Lund, III ..... 5/631 |
| 4,822,103 | A | | 4/1989 | Stenvall |
| 5,103,516 | A | | 4/1992 | Stevens |
| 5,385,322 | A | | 1/1995 | Kim |
| 5,826,841 | A | | 10/1998 | Lavore |

(Continued)

OTHER PUBLICATIONS www.littledeeper.com, posted Dec. 17, 2009.*

*Primary Examiner* — Alireza Nia
*Assistant Examiner* — Camtu Nguyen
(74) *Attorney, Agent, or Firm* — Matthew L. Grell; Balser & Grell IP Law, LLC

(57) ABSTRACT

A support for copulating couples and method thereof including, in general, a pair of support blocks, each configured as a polygon and each having six sides, (four sides, top side and bottom side with five possible tops determined by right-hand, left-hand, full upright, or sloped orientation), wherein the top and/or bottom includes an elbow indent and at one side or more includes a contour for fingers that functions to support the body weight of the top partner during copulation.

15 Claims, 6 Drawing Sheets

(56) References Cited

U.S. PATENT DOCUMENTS

| | | | | |
|---|---|---|---|---|
| 6,338,344 | B1 * | 1/2002 | Sinohui, Jr. | 128/845 |
| 6,634,453 | B2 | 10/2003 | Arthur | |
| 6,675,417 | B2 | 1/2004 | Spector | |
| 6,918,148 | B2 | 7/2005 | Auxila | |
| 7,441,293 | B1 * | 10/2008 | Singer et al. | 5/646 |
| D618,944 | S | 7/2010 | Rothstein et al. | |
| 2003/0140926 | A1 | 7/2003 | Beaudet | |
| 2007/0213772 | A1 | 9/2007 | Cianfrani | |
| 2010/0133892 | A1 | 6/2010 | Vitale | |

* cited by examiner

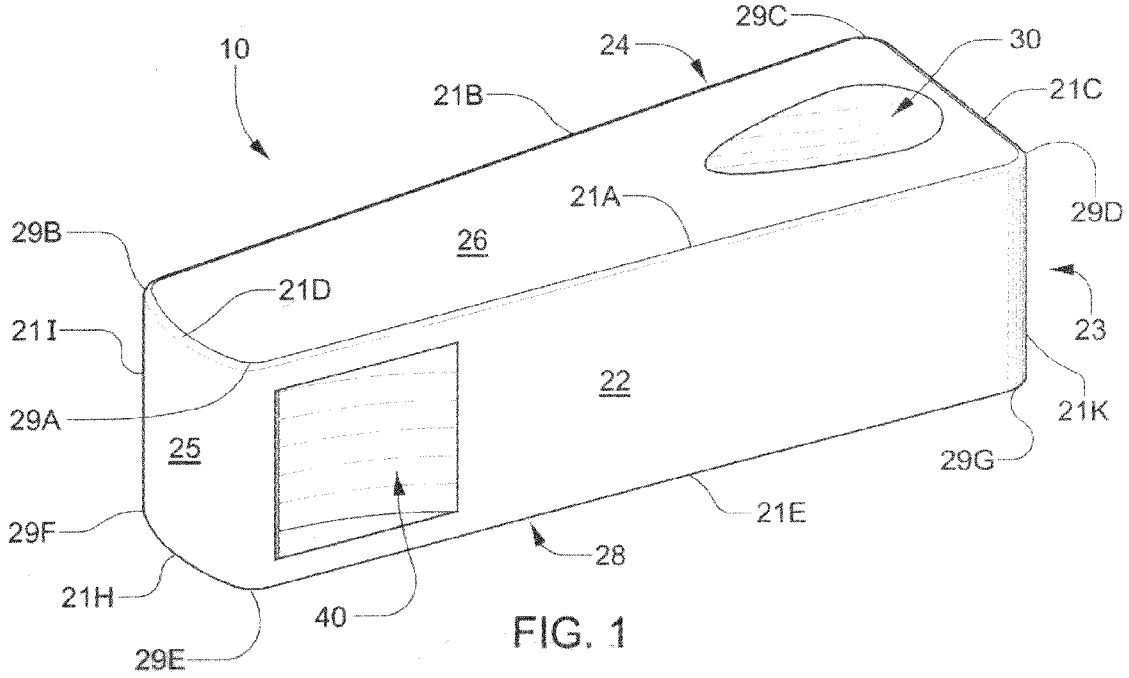
FIG. 1
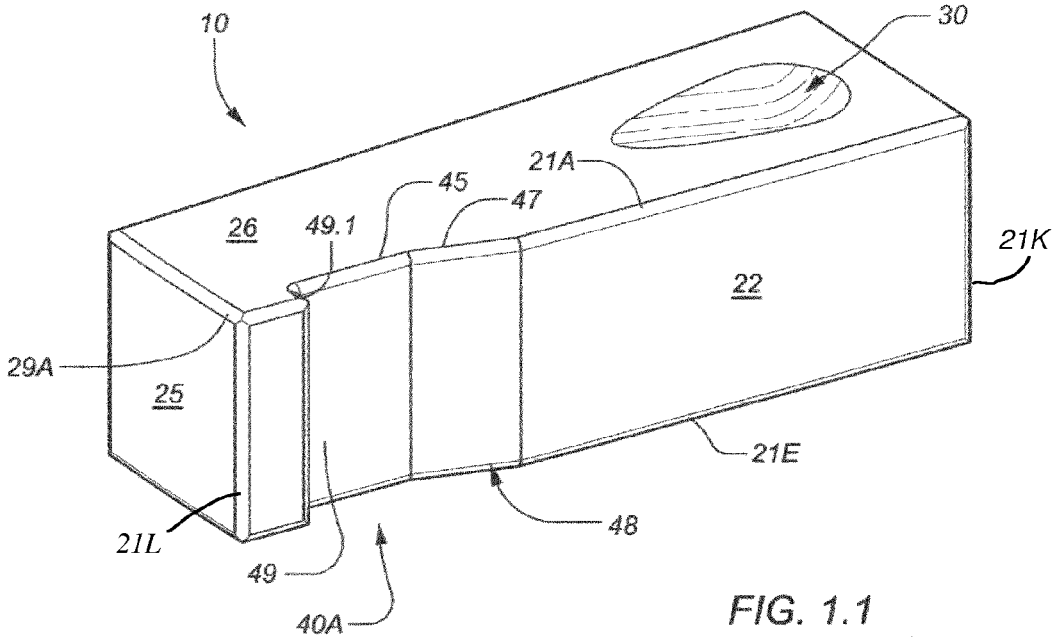
FIG. 1.1

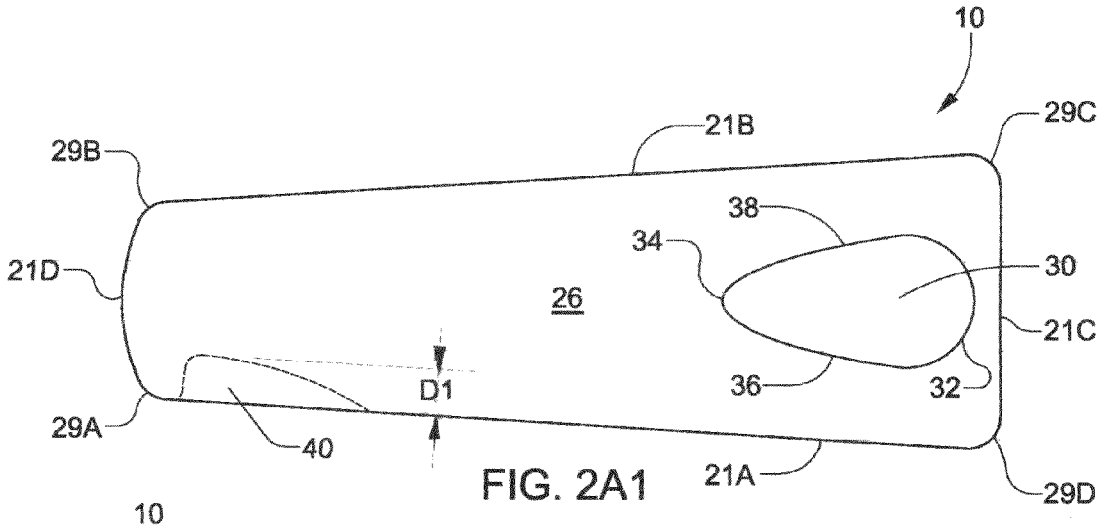
FIG. 2A1
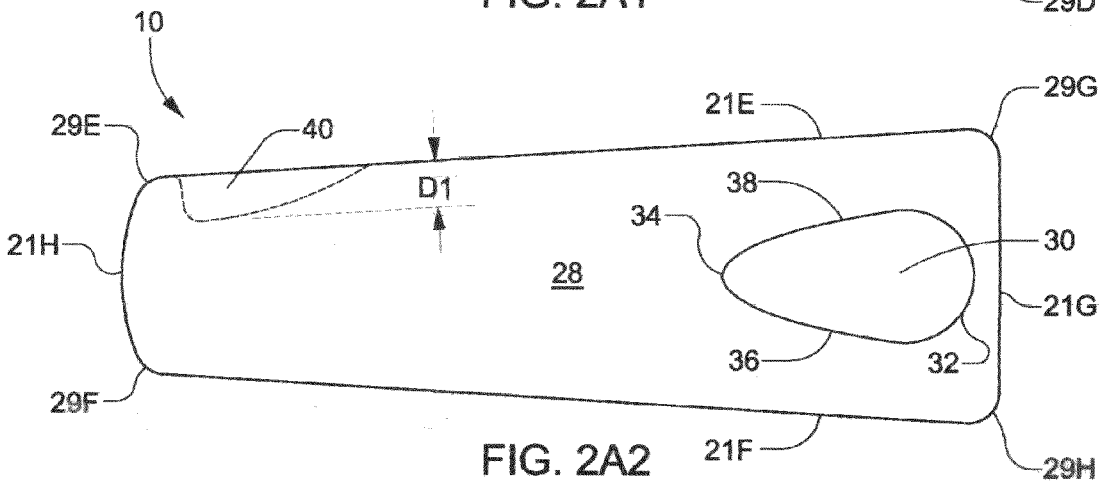
FIG. 2A2
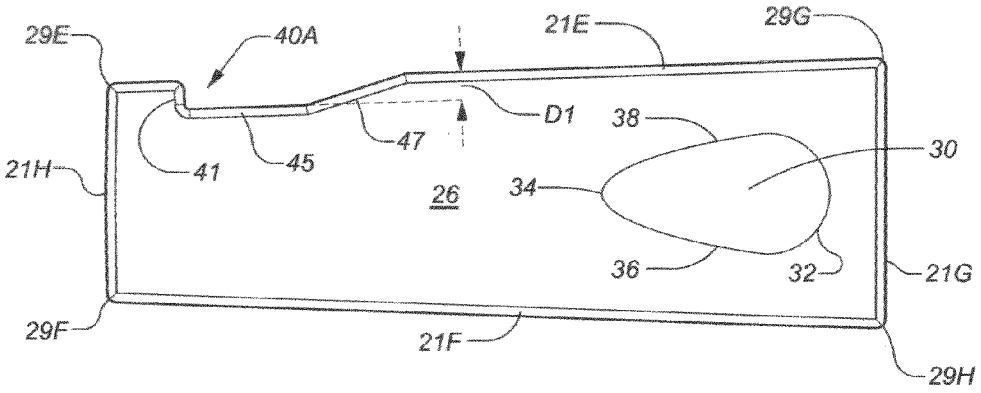
FIG. 2A2.1

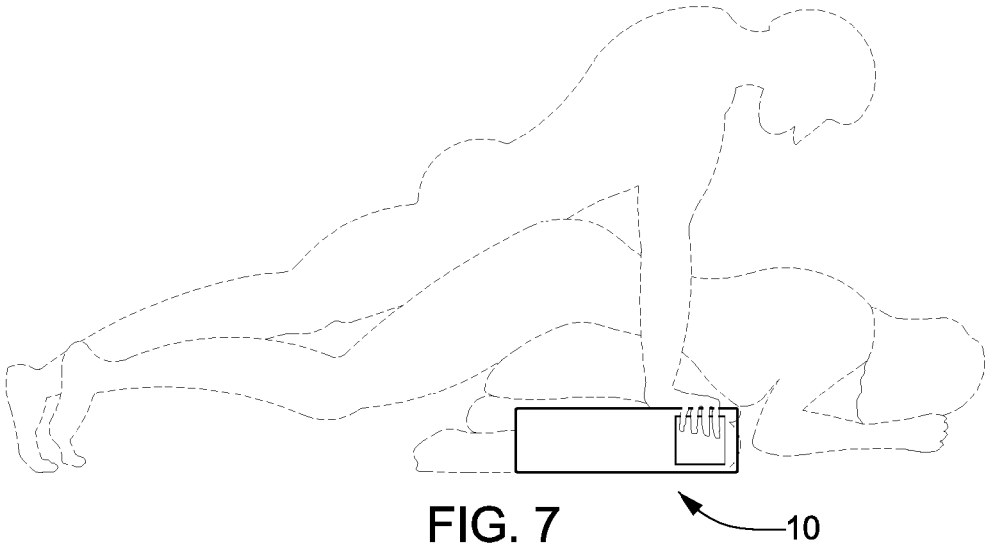
FIG. 7
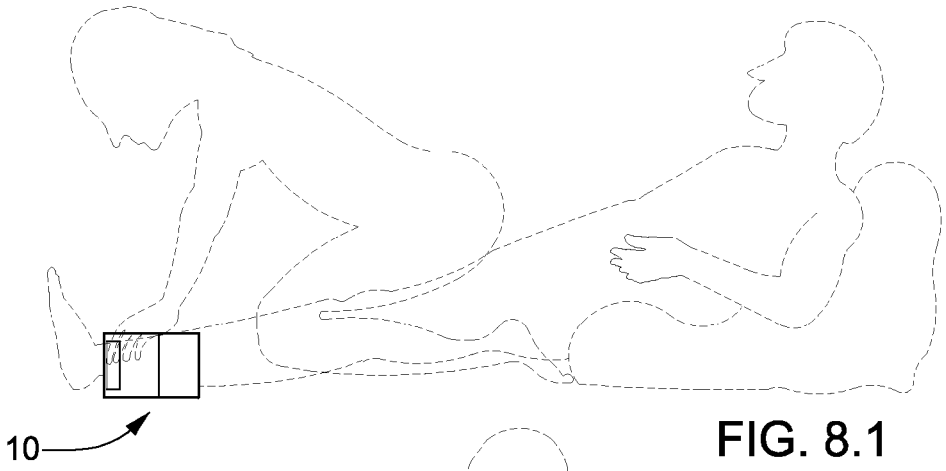
FIG. 8.1
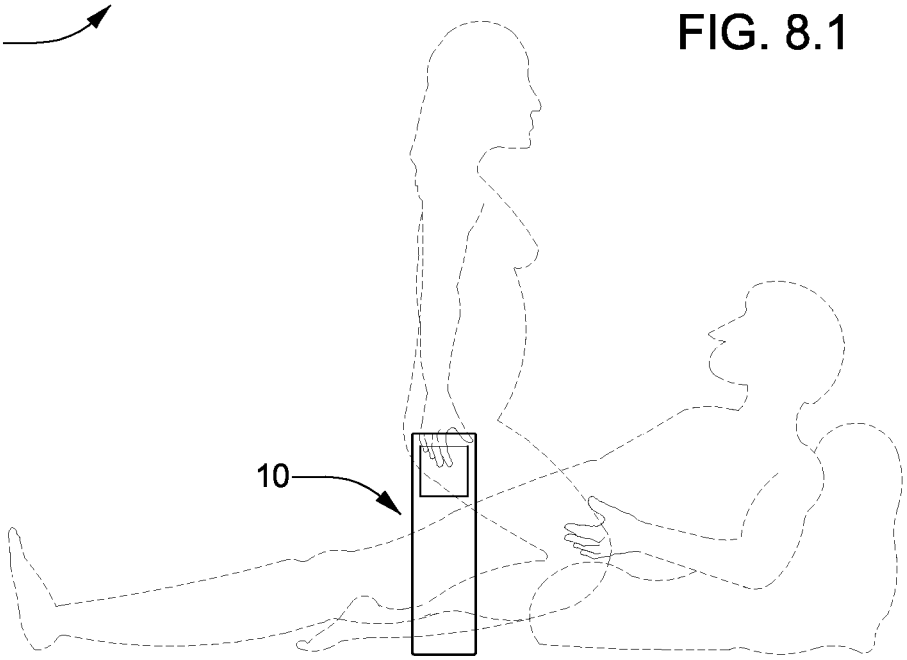
FIG. 8.2

SUPPORT FOR COPULATING COUPLES AND METHOD OF USE

PRIORITY CLAIM TO RELATED US APPLICATIONS

To the full extent permitted by law, the present United States Non-provisional Patent Application, is a Continuation-in-Part of, and hereby claims priority to and the full benefit of United States Non-provisional Application entitled "Support for Copulating Couples and Method of Use thereof," having assigned Ser. No. 12/967,033, filed on Dec. 13, 2010 (now abandoned), incorporated herein by reference in its entirety.

TECHNICAL FIELD

The disclosure relates generally to supports and more specifically it relates to armrest and hand supports for copulating couples.

BACKGROUND

Sexual intercourse over prolonged periods of time often causes fatigue in the muscles, especially any support muscles, particularly the arms, shoulders, neck and upper torso, which can rapidly bring about discomfort and/or inability to perform or reduced interest. Additionally, certain sexual positions bring out this discomfort, for example in positions where one partner supports him or herself above the other for an extended duration of time. Moreover, sexual relations or positions for the elderly, partially handicapped, overweight or obese people, and even women in the late stages of pregnancy may be uncomfortable and limited in their variety.

As a result, various aids for copulating couples are known in the prior art, for example, pillows, contoured pillows, wedges, ramps, chairs, chairs with apertures, and the like. Such aids assist with positioning one partner (the down partner) in a copulating position or positions such as missionary position. These aids assist such partner, typically the female in a male-female relationship, or the down or bottom partner, in maintaining a desired and comfortable sexual position. However, such aids are not utilized to support the body weight of the male in a male-female relationship nor the up or top partner during copulation.

Therefore, it is readily apparent that there is a recognizable unmet need for a support for copulating couples and method of use thereof that functions to support the top partner during copulation.

BRIEF SUMMARY

Briefly described, in example embodiment, the present apparatus overcomes the above-mentioned disadvantage, and meets the recognized need for a support for copulating couples and method of use thereof, comprising a pair of support blocks configured as a polygon, each having an elbow indent and a contour for fingers, and, thus, functions to support the elbow and forearm and assist a user's ability to grip the support.

According to its major aspects and broadly stated, the support for copulating couples and method thereof including, in general, a pair of support blocks, each configured as a polygon and each having six sides, four sides, top and bottom (with five possible tops determined by right-hand, left-hand, full upright, or sloped orientation), wherein the top and/or bottom includes an elbow indent and at one side or more includes a contour for fingers that functions to support the body weight of the top partner during copulation.

In a preferred embodiment, a support apparatus to provide support to a first person of a copulating couple, the apparatus including at least one support having a planar top and a planar bottom connected by one or more sides depended therefrom, an indent formed in at least one of the planar top and the planar bottom, and a contour formed in at least one side of the one or more depending sides.

In a further exemplary embodiment, a support apparatus to provide support for a first person of a copulating couple, the apparatus including at least one support having a planar top and a planar bottom connected by one or more sides depended therefrom, wherein the planar top and the planar bottom are tapered, an indent formed in at least one of the planar top and the planar bottom, wherein the indent is configured to receive the elbow of the first person, and a contour formed in at least one side of the one or more depending sides, wherein the contour is configured to receive the fingers of the first person.

In still a further exemplary embodiment, a method of supporting a top person of a two person top and bottom person copulating couple comprising the steps of: providing at least one support apparatus having a planar top and a planar bottom connected by one or more sides depended therefrom, an indent formed in at least one of the planar top and the a planar bottom, and a contour formed in at least one side of the one or more depending sides, identifying the specific sexual positions contemplated by the two person copulating couple, positioning each partner in the specific sexual positions, positioning the support apparatus in close proximity to the bottom person, utilizing the support apparatus to support the top person.

Accordingly, a feature of the support for copulating couples is its ability to support the body weight of the top partner during copulation.

Another feature of the support for copulating couples is its ability to provide physical assistance the top partner during copulation.

Still another feature of the support for copulating couples is its ability to distribute the weight of the male in a male-female relationship or the top partner during copulation evenly between elbow, forearm and palm.

Yet another feature of the support for copulating couples is its ability to provide support for the top partner in a variety of sex positions such as missionary.

Yet another feature of the support for copulating couples is its ability to support the top partner's elbows during two person sex.

Yet another feature of the support for copulating couples is its ability to support the top partner's forearms during copulation.

Yet another feature of the support for copulating couples is its ability to support the top partner's hands during copulation, and the ability of the tapered shape to universally accommodate a variety of hand grip widths.

Yet another feature of the support for copulating couples is its ability to complement other positioning wedges and bolsters during copulation.

Yet another feature of the support for copulating couples is its ability to support the feet, legs, thighs, and or knees after coitus.

Yet another feature of the support for copulating couples is its ability to enable the top person to not place their arms out beyond the natural position of their shoulders.

Yet another feature of the support for copulating couples is its ability to enable the top person's hands to not sink into the soft surface their partner lies upon, avoiding hyper-extending his/her wrists.

Yet another feature of the support for copulating couples is its ability to enable the top person to better distribute their body weight by proportioning their hand and arm pressure over a larger area, preventing sinking into the mattress.

Yet another feature of the support for copulating couples is its ability to enable the top person to not strain or fatigue his/her shoulder girdle, triceps, or forearms.

Yet another feature of the support for copulating couples is its ability to allow the top person to fully concentrate on the task at hand during copulation.

Yet another feature of the support for copulating couples is its ability to extend the top person's time of coitus, abbreviated due to the physical strength required to hold their body weight off their partner.

Yet another feature of the support for copulating couples is its ability to enable the top partner to switch from one position to another quickly and easily.

Yet another feature of the support for copulating couples is its ability to enable the top partner to increase the pleasure of coitus due to the elimination of the physical straining that distracts from the pleasure.

Yet another feature of the support for copulating couples is its ability to enable portability of the support due to its small size and weight as a result of utilizing expanded polypropylene, urethane or polyurethane.

Yet another feature of the support for copulating couples is its ability to enable ease of molding the support due to its planar surfaces and contoured surfaces.

These and other features of the support for copulating couples will become more apparent to one skilled in the art from the following Detailed Description of the Embodiments and Claims when read in light of the accompanying drawing Figures.

BRIEF DESCRIPTION OF THE DRAWINGS

The present support for copulating couples will be better understood by reading the Detailed Description of the embodiments with reference to the accompanying drawing figures, in which like reference numerals denote similar structure and refer to like elements throughout, and in which:

FIG. 1 is a perspective view of a left-hand-oriented example embodiment of support apparatus;

FIG. 1.1 is a perspective view of a right-hand-oriented alternate example embodiment of support apparatus;

FIG. 2A1 is a top view of a left-hand-oriented example embodiment of support apparatus;

FIG. 2A2 is a top view of a right-hand-oriented example embodiment of support apparatus;

FIG. 2A2.1 is a top view of a right-hand-oriented alternate example embodiment of support apparatus;

FIG. 7 is side view of an example embodiment of support apparatus shown in operation;

FIGS. 8.1 and 8.2 are side views of an example embodiment of support apparatus shown in operation.

Figure 2B:
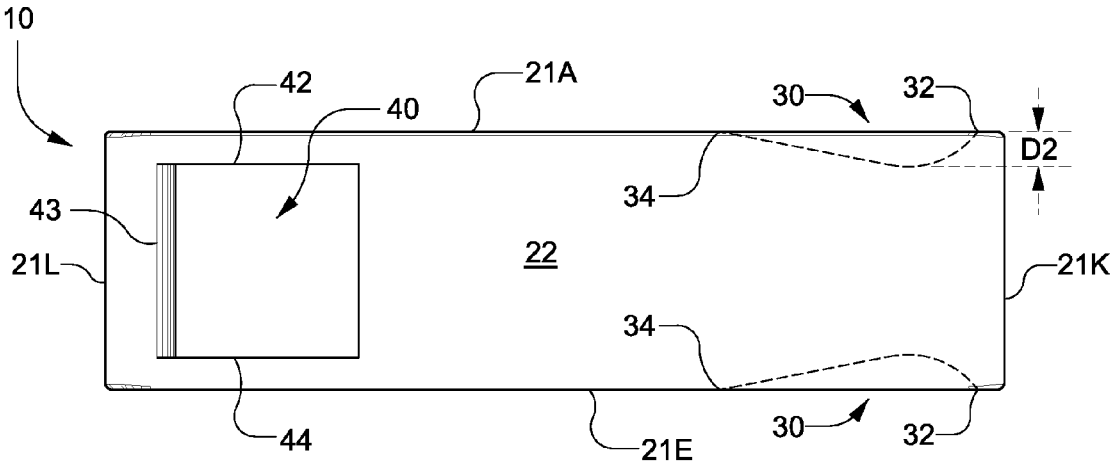
FIG. 2B is a side view of a left-hand-oriented example embodiment of support apparatus.

It is to be noted that the drawings presented are intended solely for the purpose of illustration and that they are, therefore, neither desired nor intended to limit the disclosure to any or all of the exact details of construction shown, except insofar as they may be deemed essential to the claimed invention.

DETAILED DESCRIPTION

In describing the exemplary embodiments of the present disclosure, as illustrated in FIGS. 1-9, specific terminology is employed for the sake of clarity. The present disclosure, however, is not intended to be limited to the specific terminology so selected, and it is to be understood that each specific element includes all technical equivalents that operate in a similar manner to accomplish similar functions. Embodiments of the claims may, however, be embodied in many different forms and should not be construed to be limited to the embodiments set forth herein. The examples set forth herein are non-limiting examples, and are merely examples among other possible examples.

Referring now to FIG. 1, by way of example, and not limitation, there is illustrated an example embodiment of one of an identical pair of supports for copulating couples and method of use thereof 10. Preferably, support 10 comprises a formed, cut or shaped polygon configured support such as block 20 (shown as a left hand block) having one or more sides 22, 23, 24, and 25, planar top 26, and planar bottom 28 arranged in approximately a tapered rectangle. It is contemplated that configurations other than rectangular for support 10 are contemplated herein, including, without limitation a cubic, polygonal, conical, pyramid, circle, tapered or other shapes known to one of ordinary skill in the art. Support 10 is preferably formed, molded or configured from a suitable material, such as expanded polypropylene (approximately 2.5 pound rated black bead), polyethylene, polystyrene, urethane, polyurethane or alternatively: plastic, rubber, fiber, inflatable material, gel filled material, foam filled material, wood, metal, aluminum, alloy, stainless steel, or the like, capable of providing structure to support 10. Preferably, the material includes other suitable characteristics, such as durability, water-resistance, thermal neutrality, clean-ability, light weight, pliability, resilience, chemical inertness, oxidation resistance, safety, smoothness, ease of workability, longevity, or other beneficial characteristic understood by one skilled in the art. Sides 22, 23, 24, and 25, top 26, and bottom 28 may include a rich-textured or luxurious fabric sheet such as cotton, linen, velvet, flock, faux leather (Vienna™), faux suede, silk, burlap, or the like, or a high friction material, such as a soft rubber or polymer, an adhesive, or the like covering an exterior surface. Corners 29 and edges 21 are preferably rounded (quarter of a circle arc) or rolled but alternatively may be formed as a sharp transition between sides 22, 23, 24, and 25, top 26, and bottom 28. In a preferred embodiment, support 10 has approximate dimensions (length×width×height), length of approximately thirteen and three quarters (13.75) inches along edge 21A, 21B, 21E, width of approximately five (5) inches along edge 21C and gradually tapering or narrowing from edge 21C to approximately three (3) inches at edge 21D, and height of approximately five (5) inches along edge 21I and 21K (21L and 21J not shown). It is contemplated herein that support 10 may include sizes and dimensions other than those set forth herein. Furthermore, preferably edge 21D and side 25 are configured to form a circular arc having a radius of approximately five (5) inches centered between edges 21A and 21B to receive and support the palm or hand of the top partner or person of the copulating couple. The length of the arc (edge 21D) is measured by its linear secant connecting its two end points (corners 29A and 29B).

It is contemplated herein that side 25 (its three inch width), as well as curved corners 29 are preferably configured and rounded to facilitate hand gripping of support 10 by a user.

Referring now to FIG. 1.1, by way of example, and not limitation, there is illustrated an alternate example embodiment of one of an identical pair of supports for copulating couples and method of use thereof 10. Preferably, support 10, in this alternate embodiment, comprises a similar formed, cut or shaped polygon configured support such as block 20 (shown as a left hand block) having one or more sides 22, 23, 24, and 25, planar top 26, and planar bottom 28 arranged in approximately a tapered rectangle. Moreover, side 22 having a perimeter defined by edges 221A, 21K, 21E, and 21L and further side 22 preferably includes a partially curved, waved, shaped, irregular, rounded, indented, contoured surface, finger recess, such as contour 40A configured to releasably maintain a person's fingertips in a desired position and provide a gripping area or surface. Preferably, contour 40A is positioned approximate edge 21L and includes one or more transition surfaces such as sides 48, 49, and 49.1. In this alternate example, preferably side 49 is approximately parallel to side 22 and position between sides 48 and 49.1, side 48 is approximately at an acute angle relative to side 22, and side 49.1 is approximately perpendicular to side 22.

Referring now to FIG. 2A1, there is illustrated a top view of a left-hand-oriented example embodiment of support 10. Specifically, top 26 preferably includes perimeter edges 21A, 21B, 21C, and 21D, and corners 29A, 29B, 29C, and 29D as rounded transitions between two or three such edges. It is contemplated herein that support 10 may include configurations other than rounded edges or corners for edges 21A, 21B, 21C, and 21D, and corners 29A, 29B, 29C, and 29D or the like known to one of ordinary skill in the art. In a preferred embodiment, top 26 has approximately a length of thirteen and three quarters (13.75) inches running along edges 21A and 21B and a width of approximately five (5) inches along edge 21C and gradually narrowing equilateral straight edges 21A/21B from edge 21C to approximately three (3) inches at edge 21D. Preferably, top 26 includes indent such as elbow indent 30 capable of releasably retaining a person's elbow in a desired position. Indent 30 is preferably egg shaped and is positioned approximately centered between edges 21A and 21B and proximate edge 21C.

It is contemplated herein that side 25 (its three inch width), tapered configuration of edges 21A and 21B, as well as curved edges 21 are preferably configured and rounded to facilitate hand gripping of support 10 by a user.

In use, a user of support 10 may preferably position support 10 with either surface 26 or 28 facing down and position his/her left/right elbow in elbow indent 30, position his/her left/right forearm on top 26/bottom 28, and grip tapered edges 21A and 21B/21E and 21F with his/her left/right hand proximate edge 21D/21H to support his/her body weight with support 10.

Referring now to FIG. 2A2, there is illustrated a top view of a right-hand-oriented example embodiment of support 10. Specifically, bottom 28 (rotated to be on top for the right-hand-oriented example) preferably includes perimeter edges 21E, 21F, 21G, and 21H, and corners 29E, 29F, 29G, and 29H as rounded transitions between two or three such edges. It is contemplated herein that support 10 may include configurations other than rounded edges or corners for edges 21E, 21F, 21G, and 21H, and corners 29E, 29F, 29G, and 29H or the like known to one of ordinary skill in the art. In a preferred embodiment, bottom 28 (a mirror of top 26) has approximately a length of thirteen and three quarters (13.75) inches running along edges 21E and 21F and a width of approximately five (5) inches along edge 21G and gradually narrowing from edge 21G to approximately three (3) inches at edge 21H. Preferably, bottom 28 includes indent such as elbow indent 30 capable of releasably retaining a person's elbow in a desired position. Indent 30 is preferably egg shaped and is positioned approximately centered between edges 21E and 21F and proximate edge 21G.

It is contemplated herein that side 25 (shown in FIG. 1) (its three inch width), tapered configuration of edges 21A and 21B, as well as curved edges 21 are preferably configured and rounded to facilitate hand gripping of support 10 by a user.

In use, a user of support 10 may preferably position support 10 with top 26 (shown in FIG. 1) facing down and position their right elbow in elbow indent 30, position their right forearm on bottom 28, and grip tapered edges 21E and 21F with their right hand proximate edge 21H to support their body weight with support 10.

Referring now to FIG. 2A2.1 and in light of FIGS. 1 and 2A and 2A2, there is illustrated a right-hand-oriented top view of an alternate example embodiment of support 10. Preferably, surface 22 includes a contoured surface such as contour 40A comprises one or more edges such as edges 41, and 47 configured to releasably maintain a person's fingertips in a desired position and provide a gripping area or surface. Additionally, contour 40A comprises formed, cut or carved recess or contour in side 22 and positioned approximately between edges 21A and 21E and proximate edge 21L of surface 22. It is contemplated herein that one or more edges such as edges 41, 45 and 47 may be configured to form other shapes and dimensions capable of defining a contoured surface or recess configured to releasably maintain a person's fingertips in a desired position and provide a gripping edge or edges or surface.

In use, a user of support 10 may preferably position support 10 with bottom 28 facing down and position his/her right elbow in elbow indent 30, position his/her right forearm on top 26, grip tapered edges 21E and 21F with his/her right hand, and/or insert right hand into contour 40A proximate edge 21H enabling releasable gripping of support 10, thereby supporting the user's body weight with support 10.

In an alternative use, a user of support 10 may preferably position support 10 with top 26 facing down and position his/her left elbow in elbow indent 30, position his/her left forearm on bottom 28, grip tapered edges 21A and 21B with his/her left hand, and insert left hand fingers into contour 40A proximate edge 21D enabling releasable gripping of support 10, thereby supporting the user's body weight with support 10.

It is recognized that alternate support 10 may be configured to be universal and utilized by either the left or right hand/elbow/arm by rotating support 10 one-hundred eighty (180) degrees, thereby supporting a user's body weight with support 10 when the user is in a horizontal or kneeling position.

Referring again to FIGS. 2A1, 2A2 and 2A2.1, elbow indent 30 preferably comprises a formed, cut or carved contour or recess in top 26 and/or bottom 28 having a base 32, sides 36, 38 and tip 34 configured in an egg shape. In a preferred embodiment, elbow indent 30 is positioned starting approximately one-half inch (0.5) from edge 21C/21G and has approximate dimensions (length×width×depth), length of approximately two (2.0) inches, width of approximately one and a half (1.5) inches at its widest, and a depth of one-half (½) centimeter. Sides 36 and 38 preferably extend from base 32 in an arcing configuration gradually narrowing and connecting to form circle arc such as tip 34 approximately two (2.0) inches from base 32. Moreover, base 32 of elbow indent 30 is preferably configured to form an 'S' curve indent to a depth D2 of approximately one-half (0.5) centimeter below the surface of top 26/bottom 28 (shown in FIG. 2B) over an approximately linear one-half (0.5) inch distance. Preferably from back to front elbow indent 30 reaches its maximum depth of one-half (0.5) centimeter at approximately one (1) inch from edge 21C/21G. Furthermore, segments of sides 36, 38 of elbow indent 30 are preferably configured to form an 'S' curve indent to a depth D2 of approximately one-half (0.5) centimeter below the surface of top 26/bottom 28 (as shown in FIG. 2B) over approximately linear one-half (0.5) inch distance. The indent of elbow indent 30 in the surface of top 26 and bottom 28 preferably extends from base 32 to tip 34 and gradually rises therefrom to meet tip 34 at the surface of top 26/bottom 28.

It is contemplated herein that top 26 and bottom 28 are configured to be symmetrical or mirror images of one another, and both top 26 and bottom 28 having elbow indent 30 configured therein.

Figure 2C:
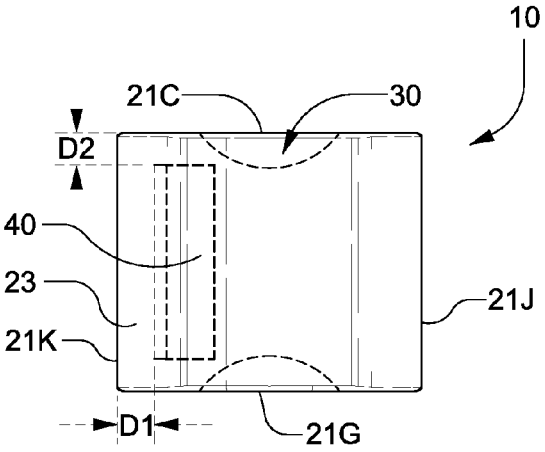
FIG. 2C is a back side view of a left-hand-oriented example embodiment of support apparatus.

Referring now to FIG. 2B and in light of FIGS. 1 and 2A, there is illustrated a left-hand-oriented side view of an example embodiment of support 10. Preferably, surface 22 includes contour or recess such as finger recess 40 configured to releasably maintain a person's fingertips in a desired position and provide a gripping area or surface. Additionally, recess 40 comprises formed, cut or carved recess in side 22 having edges 42, 43 and 44 configured in approximately a square and positioned approximately between edges 21A and 21E and proximate edge 21L of surface 22 (approximately 0.625 inch from edge 21L). In a preferred embodiment, finger recess 40 has approximate dimensions (length×width×depth), length of approximately 2.875 inches defined by edges 42/44 (approximately 0.625 inches from edge 21I, width of approximately 2.875 inches defined by edge 43 at surface 22, and depth D1 of approximately three quarters (0.75) of an inch, as shown in FIGS. 2A and 2C.

In use, a user of support 10 may preferably position support 10 with bottom 28 facing down and position his/her left elbow in elbow indent 30, position his/her left forearm on top 26, grips tapered edges 21A and 21B with his/her left hand, and/or inserts left hand fingers into finger recess 40 proximate edge 21L enabling releasable gripping of support 10, thereby supporting the user's body weight with support 10.

In an alternative use, a user of support 10 may preferably position support 10 with top 26 facing down and position his/her right elbow in elbow indent 30, position his/her right forearm on bottom 28, grip tapered edges 21E and 21F with his/her right hand, and insert right hand fingers into finger recess 40 proximate edge 21H enabling releasable gripping of support 10, thereby supporting the user's body weight with support 10.

It is recognized that support 10 may be configured to be universal and utilized by either the left or right hand/elbow/arm by rotating support 10 one-hundred eighty (180) degrees, thereby supporting a user's body weight with support 10 when the user is in a horizontal or kneeling position.

Preferably, the approximate five (5) inch height of sides 22 and 24 of support 10 allows for the user's forearms and/or hands to be placed on top 26 or bottom 28 creating a restful position for the top person or partner and a non- or reduced-weight-bearing situation for the bottom partner or person of a copulating couple.

Additionally, the approximately thirteen and three quarters (13.75) inch length of sides 22, 24, top 26, and bottom 28 of support 10 is preferably configured to accommodate the length of the top partner's forearm.

Alternatively, the approximate three (3) inch width of sides 26 and 28 of support 10 near edges 21D/21H allows for the user's forearms and/or hands to be placed on side 26 or creating another restful position for the top partner and a reduced weight-bearing situation for the bottom partner.

Yet another alternative, the approximate thirteen and three quarter (13.75) inch length of sides 22 and 24 of support 10, when side 23 is positioned down to enable support 10 to be stood up on side 23, creating yet another restful position for the top partner, specifically when resting on their knees, and a non- or reduced-weight-bearing situation for the bottom partner.

Referring now to FIG. 2C, there is illustrated a back side view of an example embodiment of support 10. Preferably, surface 23 having edges 21C, 21J, 21G, and 21K that functions to support the body weight of the top partner during copulation. Preferably, elbow indent 30 has a maximum depth D2 of one-half (0.5) centimeter at approximately one (1) inch from edge 21C. Moreover, finger recess 40 has maximum depth D1 of approximately three quarters (0.75) of an inch from edge 21K. Still further, elbow indent 30 is preferably indented to a depth D2 of approximately one-half (0.5) centimeter.

In another alternative use, a user of support 10 may preferably position support 10 with side 23 facing down and position his/her left/right hand on arc side 25, which fits the heel and distal metacarpal portions of the palm of the user's hand, and insert left/right hand fingers into finger recess 40 proximate edge 21D/21H enabling releasable gripping of support 10, thereby supporting the user's body weight with support 10.

In another alternative use, a user of support 10 may preferably position support 10 with side 22 facing down and position his/her left/right hand on sides 24, enabling releasable gripping of support 10 (5 inch width, 3-4 inch height), thereby supporting the user's body weight with support 10.

It is recognized herein that support 10 distributes user's body weight over a larger area than utilizing bare palms of the user's hands, thus preventing the user's hands from sinking into the mattress or other soft surface.

It is further recognized herein that support 10 is preferably placed on a bed, floor, or other surface during sexual intercourse to provide support for the top person during such activity.

When using support 10 with top 26/bottom 28 facing up, the five (5) inch height of support 10 is preferably ideal for supporting the top person's weight when such person is prone above his/her partner to enable the person's upper arms to remain closer to the chest wall, which allows their shoulders to remain in a naturally locking, weight-bearing position, to further prevent the shoulder girdles' muscles from being strained. Moreover, the five (5) inch height of support 10 enables a user to lock his/her elbows in position, leaving their triceps fully flexed in a strength position and the least strained position. With elbows locked, the muscles of the triceps and forearms are not being stressed, and the wrists are not hyperextended, thereby supporting the user's body weight with support 10.

Figure 3:
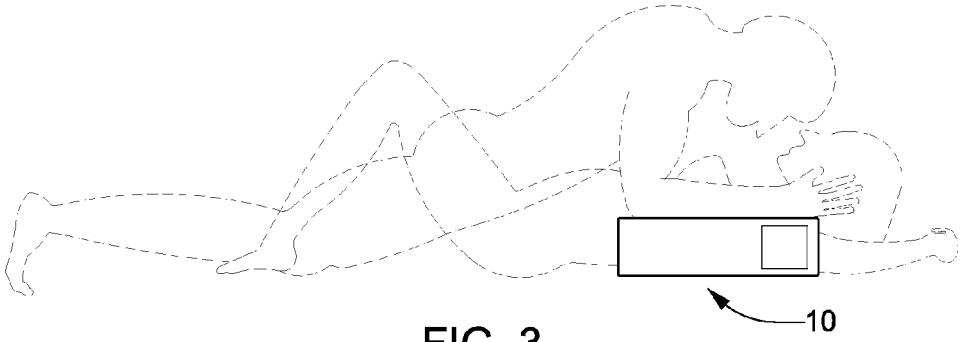
FIG. 3 is side view of an example embodiment of support apparatus shown in operation.

Referring now to FIG. 3, there is illustrated a side view of an example embodiment of support 10 shown in use. Preferably, support 10 is positioned parallel to the mid-section along each side of the bottom partner lying on his/her back, the top partner facing the bottom partner, and the top partner supporting his/her body weight by placing both elbows and forearms on any of sides 22, 24, top 26, or bottom 28 of support 10. This allows face-to-face eye gazing, kissing, and cuddling between partners while reducing the amount of the top partner's body weight being placed on the bottom partner during coitus.

Figure 4:
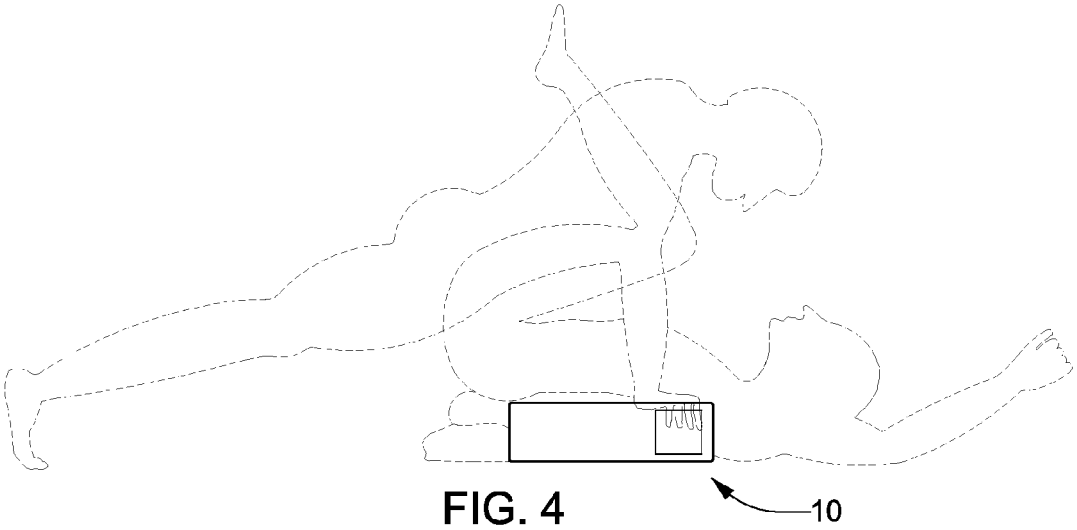
FIG. 4 is side view of an example embodiment of support apparatus shown in operation.

Referring now to FIG. 4, there is illustrated a side view of an example embodiment of support 10 shown in use. Preferably, support 10 is positioned parallel to the upper body along each side of the bottom partner in a supine position or lying on his/her back with pillows or other cushions propped under their buttocks or pelvis, thighs resting back on his/her abdomen, and the top partner in a prone position supporting his/her body weight by placing both hands on any of side 24, top 26, or bottom 28 of support 10 and his/her toes or balls of his/her feet.

Figure 5:
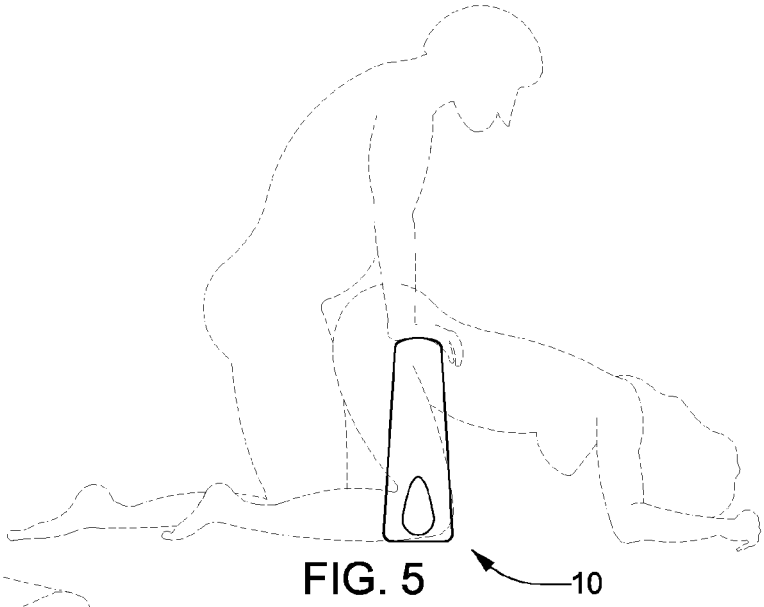
FIG. 5 is side view of an example embodiment of support apparatus shown in operation.

Referring now to FIG. 5, there is illustrated a side view of an example embodiment of support 10 shown in use. Preferably, support 10 is positioned approximately parallel to the thigh along each side of the bottom partner positioned on their knees, bent over with their back facing up and the top partner approaching from the rear on his/her knees positioned behind the bottom partner, and the top partner on his/her knees supporting his/her body weight with nearly straight elbows by placing each hand on side 25 of support 10 while side 23 is positioned down on the surface.

Figure 6:
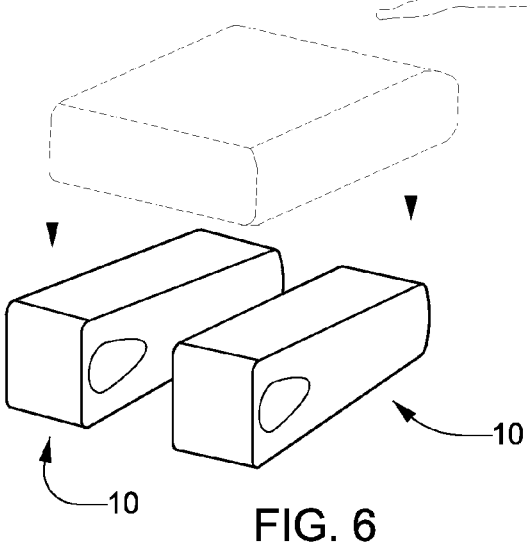
FIG. 6 is perspective view of an example embodiment of support apparatus shown with a pillow.

Referring now to FIG. 6, there is illustrated a side view of an example embodiment of support 10 shown in use. Preferably, two supports 10 are positioned approximately parallel to one another leaving a one to four inch gap, and a pillow or other cushion P is positioned on the up surface such as side 24 of support 10. Once in place the down partner lies back on the pillow P in a pelvic-titled position with the down partner's tailbone comfortably positioned in the gap between supports 10 and the down partner's sacroiliac joint areas remain supported by supports 10.

Referring now to FIG. 7, there is illustrated a side view of an example embodiment of support 10 shown in use. Preferably, support 10 is positioned approximately parallel to the mid-section along each side of the bottom partner prone on their stomach with pillows or other cushions P positioned under their abdomen, and the top partner approaching from the rear supporting his/her body weight by placing both hands on top 26, bottom 28, or side 24 of support 10 and toes or balls of his/her feet, providing either a five (5) inch base of hand support or, a three (3) to four (4) inch base of hand support.

Referring now to FIG. 8.1, there is illustrated a side view of an example embodiment of support 10 shown in use. Preferably, support 10 is positioned approximately parallel to the bottom partner's lower leg along each side of the bottom partner relaxing on his/her back, and the top partner on their knees, bent over with his/her back towards the bottom partner's head, with the top partner supporting his/her body weight by placing each hand on side 26 and 28 respectively of support 10 while side 28 and 26 respectively is positioned down on the surface.

Referring now to FIG. 8.2, there is illustrated a side view of an example embodiment of support 10 shown in use. Preferably, support 10 is positioned approximately perpendicular to the bottom person's lower leg along each side of the bottom partner relaxing on his/her back, and the top partner on their knees, upright with his/her front towards the bottom partner's head, with the top partner supporting his/her body weight by placing each hand on side 25 of support 10 while side 23 is positioned down on the surface.

It is contemplated herein that support 10 may be utilized in a variety of sexual positions to support the top partner and in other positions, may be used to support the bottom partner.

Figure 9:
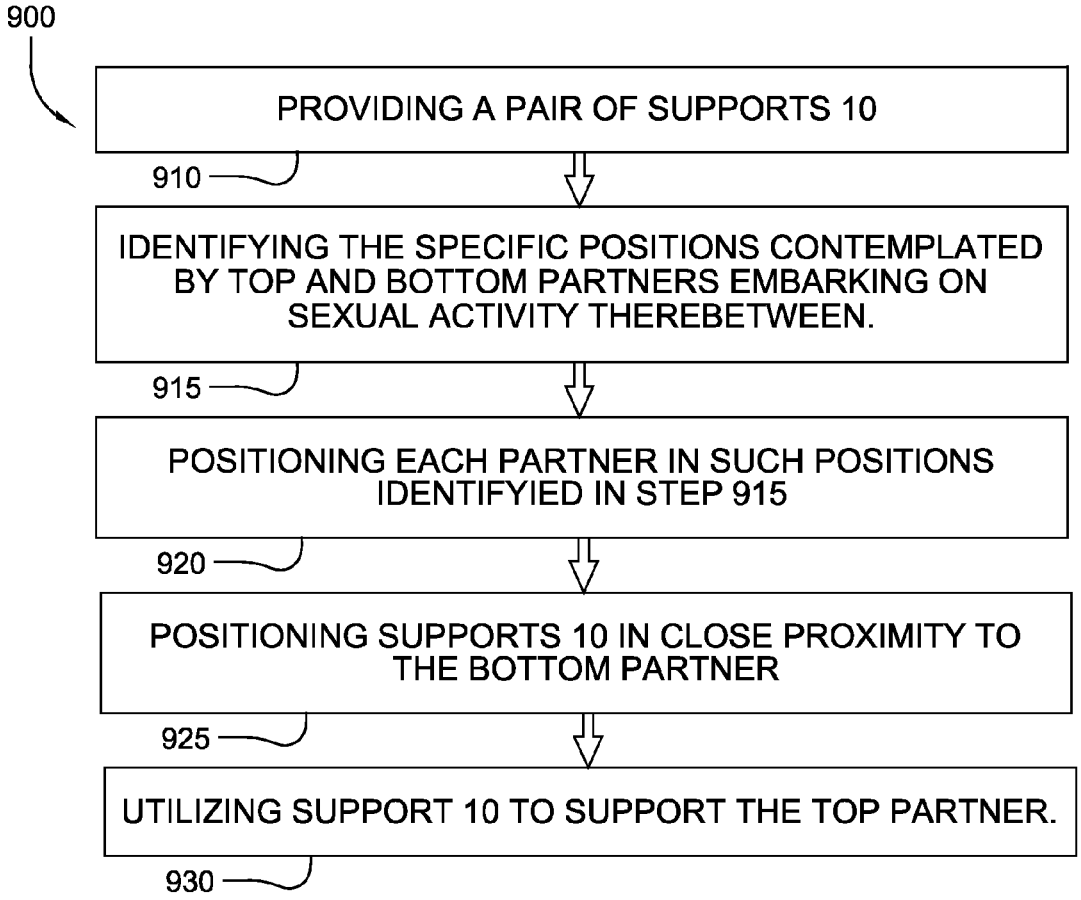
FIG. 9 is a flow diagram of a method for supporting a top partner during coitus.

Referring now to FIG. 9, there is illustrated a flow diagram 900 of a method for supporting a top partner during coitus. In block or step 910, providing a pair of support 10 configured as a polygon having six sides 22, 23, 24, and 25, top 26, and bottom 28 arranged in approximately a rectangle, wherein top 26 and bottom 28 include elbow indent 30 and side 22 includes finger recess 40 for gripping, as described above in FIGS. 1-8. In block or step 915, identifying the specific positions contemplated by top and bottom partners embarking on sexual activity therebetween. In block or step 920, positioning each partner in such positions identified in step 915. In block or step 925, positioning support 10 in close proximity to the bottom partner. In block or step 930, utilizing support 10 to support the top partner, thereby, supporting the top partner's body weight with support 10 in a first position. In block or step 935, utilizing reversible support 10 to support the top partner, thereby, stabilizing or supporting the top partner's body weight with support 10 in a second position.

The foregoing description and drawings comprise illustrative embodiments of the present invention. Having thus described exemplary embodiments, it should be noted by those ordinarily skilled in the art that the disclosures within are exemplary only, and that various other alternatives, adaptations, and modifications may be made within the scope of the present invention. Merely listing or numbering the steps of a method in a certain order does not constitute any limitation on the order of the steps of that method. Many modifications and other embodiments of the invention will come to mind to one ordinarily skilled in the art to which this invention pertains, having the benefit of the teachings presented in the foregoing descriptions and the associated drawings. Although specific terms may be employed herein, they are used in a generic and descriptive sense only and not for purposes of limitation. Moreover, the present invention has been described in detail; it should be understood that various changes, substitutions and alterations can be made thereto without departing from the spirit and scope of the invention as defined by the appended claims. Accordingly, the present invention is not limited to the specific embodiments illustrated herein, but is limited only by the following claims.

What is claimed is:

1. A support apparatus adapted to provide a body support for a first person of a copulating couple, the first person having a left arm and a right arm, each arm having an elbow bent as a corner having a tip, a forearm, a hand, a palm, and fingers, the apparatus comprising:

at least one solid support block with no through holes having a planar top and a planar bottom connected by one or more sides depended therefrom, wherein said planar top and said planar bottom are tapered from a back side to a front side, and wherein said planar top is configured to support the forearm of the first person, and wherein said tapered planar top and said planar bottom, proximate said front side, are configured to receive the palm of the first person, and wherein said one or more sides proximate said front side includes a recess configured to receive the fingers of the first person;

an egg shaped indent formed in at least one of said planar top and said planar bottom positioned proximate said back side, wherein said indent is configured to receive the tip of the elbow of the first person; and wherein said support block provides the first person of a copulating couple with body support.

2. The support apparatus of claim 1, wherein said front side is rounded.

3. The support apparatus of claim 2, further comprising a first recess in said one or more sides positioned proximate said front side.

4. The support apparatus of claim 3, wherein said first recess is configured to conform to the fingers of the first person.

5. The support apparatus of claim 2, wherein said back side is configured to support the apparatus.

6. The support apparatus of claim 5, wherein said front side is configured to support the palm of the first person.

7. The support apparatus of claim 1, wherein said support apparatus is formed of a material selected from the group consisting of polypropylene, polyethylene, polystyrene, urethane, polyurethane, plastic, rubber, fiber, and combinations thereof.

8. The support apparatus of claim 1, wherein said egg shaped indent is formed in both of said planar top and said planar bottom.

9. The support apparatus of claim 8, wherein said planar top and said planar bottom are reversible between the right arm and the left arm.

10. A support apparatus adapted to provide a body support for a first person and a second person of a copulating couple, the first person having a left arm and a right arm, each arm having an elbow bent as a corner having a tip, a forearm, a hand, a palm, and fingers, the apparatus comprising:

a pair of solid support blocks with no through holes positioned alongside the second person, each of said pair of supports blocks having a planar top and a planar bottom connected by one or more sides depended therefrom, wherein said planar top and said planar bottom are tapered from a back side to a front side, and wherein said planar top is configured to support the forearm of the first person, and wherein said planar top and said planar bottom, proximate said front side, are configured to receive the palm of the first person, and wherein said one or more sides proximate said front side includes a first recess configured to receive the fingers of the first person;

an egg shaped indent formed in at least one of said planar top and said planar bottom positioned proximate said back side, wherein said indent is configured to receive the tip of the elbow of the first person; and wherein said supports blocks provide the first person of a copulating couple with body support.

11. The support apparatus of claim 10, wherein said egg shaped indent is formed in both of said planar top and said planar bottom.

12. The support apparatus of claim 11, wherein said planar top and said planar bottom are reversible between the right arm and the left arm.

13. The support apparatus of claim 10, wherein said back side is configured to support the apparatus.

14. The support apparatus of claim 13, wherein said front side is configured to support the palm of the first person.

15. The support apparatus of claim 10, wherein said support apparatus is formed of a material selected from the group consisting of polypropylene, polyethylene, polystyrene, urethane, polyurethane, plastic, rubber, fiber, and combinations thereof.

* * * * *